US005169880A

United States Patent [19]

Yoshida et al.

[11] Patent Number: 5,169,880

[45] Date of Patent: Dec. 8, 1992

[54] PROCESS FOR MAKING FOUNDRY SAND MOLD

[75] Inventors: Akira Yoshida; Shigeo Nakai; Naoki Kyochika; Akio Mamba, all of Aichi, Japan

[73] Assignee: Kao Corporation, Tokyo, Japan

[21] Appl. No.: 666,203

[22] Filed: Mar. 7, 1991

[30] Foreign Application Priority Data

Apr. 3, 1990 [JP] Japan ..... 2-89636

[51] Int. Cl.[5] ..... B22C 1/22

[52] U.S. Cl. ..... 523/145; 523/139

[58] Field of Search ..... 523/139, 145

[56] References Cited

U.S. PATENT DOCUMENTS

Re. 32,720 7/1988 Lemon et al. ..... 523/145

4,076,685 2/1978 Kögler ..... 523/139

4,097,443 6/1978 Nakamura et al. ..... 523/145

4,988,745 1/1991 Iyer et al. ..... 524/541

5,021,539 6/1991 Armbruster et al. ..... 523/145

*Primary Examiner*—Paul R. Michl

*Assistant Examiner*—Peter Szekely

*Attorney, Agent, or Firm*—Birch, Stewart, Kolasch & Birch

[57] ABSTRACT

A foundry sand mold is produced by molding a granular refractory material with the use of (1) a binder comprising a silane coupling agent, a water-soluble phenolic resin and a silane compound selected from an alkyl silicate having 1 to 8 carbon atoms in the alkyl group, its lower condensate, a silicone oil and a modified silicone oil and (2) a hardening agent comprising an organic ester.

9 Claims, No Drawings

PROCESS FOR MAKING FOUNDRY SAND MOLD

FIELD OF THE INVENTION

The present invention relates to a process for making a foundry sand mold in a self-hardening mold and a gas-hardening mold.

More particularly, the present invention relates to an improved process for making a foundry sand mold which is used in a process wherein a silane coupling agent and a water-soluble phenolic resin are used as a binder which is hardened with an organic ester.

DESCRIPTION OF RELATED ACT

Self-hardening molding, cold box molding and the Croning process (shell process) are known as a molding processes for making molds, such as main molds and cores, through the use of an organic binder. In particular, an organic self-hardening molding process has already become a general molding process instead of an inorganic one from the viewpoint of productivity, the quality of castings and safety and hygiene mainly in the field of machine castings.

Meanwhile, the Croning process wherein a granular refractory material coated with a phenolic resin, i.e., a coated sand, is heat-hardened to make a mold has hitherto been used for making a mold at a medium or high speed.

However, in order to achieve energy saving in molding and improve the molding rate and the qualities of molds and castings, the cold box molding process wherein hardening is conducted at room temperature with a gaseous or aerosol substance has earnestly been attempted as a molding process which substitutes for the Croning process in the foundry industry.

Known binder compositions used in the organic self-hardening molding process and gas-hardening molding process include a binder composition for molding sand comprising a water-soluble phenolic resin as a binder and an organic ester as a hardening agent for the binder disclosed in Japanese Patent Laid-Open Nos. 130627/1975, 154433/1983 and 154434/1983.

The molding process wherein use is made of the above-described binder is featured that it is less susceptible to sulfurizing than the molding process wherein use is made of an acid-hardening resin, because the binder is free from sulfur atoms. In this process, however, since the strength of the mold is low, the amount of resin necessary for the molding is very large, which causes a large amount of gas to generate during pouring, so that gas defects tend to occur. Further, it has drawbacks such as poor profitability and poor reusability of sand, so that an improvement in this process has been desired in the art.

In order to improve the strength of a mold prepared by making use of the above-described binder, it is a common practice to use a binder also containing a silane coupling agent, and the effect of the combined use is recognized. Since, however, the effect is lower than that of the acid-hardening resin, a further improvement has been desired.

SUMMARY OF THE INVENTION

The present inventors have made intensive studies with a view to solving the above-described problems and, as a result, have found that the mold strength is remarkably improved by a process for making a foundry sand mold by hardening a binder composed of a silane coupling agent and a water-soluble phenolic resin with an organic ester, wherein the binder further comprises an alkyl silicate having an alkyl group having 1 to 8 carbon atoms or its lower condensate or a modified or unmodified silicone oil, which has led to the completion of the present invention.

Accordingly, the present invention provides a process for making a foundry sand mold by molding a granular refractory material through the use of a silane coupling agent and a water-soluble phenol both as a binder and an organic ester as a hardening agent, characterized in that said binder further comprises an alkyl silicate having an alkyl group having 1 to 8 carbon atoms or its lower condensate or a modified or unmodified silicone oil (hereinafter referred to as the "silane compound").

In other words, the invention provides a process for making a foundry sand mold, which comprises molding a granular refractory material with the use of (1) a binder comprising a silane coupling agent, a water-soluble phenolic resin and a silane compound selected from an alkyl silicate having 1 to 8 carbon atoms in the alkyl group, its lower condensate, a silicone oil and a modified silicone oil and (2) a hardening agent comprising an organic ester.

It is preferable that 100 parts by weight of the granular refractory material, 0.001 to 1 part by weight of the silane coupling agent, 0.4 to 15 parts by weight of the phenolic resin, 0.001 to 10 parts by weight of the silane compound and 0.05 to 9 parts by weight of the organic ester are used. The process may be conducted by the gas-hardening molding process or the self-hardening molding process.

A silane coupling agent has hitherto been regarded to be useful for improving the mold strength and widely used as a component of the binder. The structure of a representative compound thereof is represented by the following general formula:

$$X-\overset{\overset{(CH_3)_{3-n}}{|}}{Si}-(OR)_n$$

wherein n is 2 or 3,

R is a methyl or ethyl group,

X is an organic reactive group capable of combining with an organic resin, and representative examples thereof include vinyl, methacryl, epoxy, amino and mercapto groups.

The comparison of the above-described compound with the silane compound further added to the binder of the present invention has revealed that although the presence of a silicon atom in the structure is common to these compounds, their structures are remarkably different from each other. It hat not been recognized at all that the addition of the silane compound used in the present invention in combination with a silane coupling agent as a component of the binder brings about a significant effect of improving the mold strength.

In order to make a foundry sand mold by the self-hardening molding process in the present invention, 100 parts by weight of a granular refractory material, 0.001 to 1 part by weight, preferably 0.002 to 0.1 part by weight of a silane coupling agent, 0.001 to 10 parts by weight, preferably 0.002 to 5 parts by weight of the silane compound, 0.05 to 9 parts by weight, preferably 0.1 to 5 parts by weight of an organic ester as a hardening agent and 0.4 to 15 parts by weight, preferably 0.6 to 5 parts by weight of an aqueous solution of a water-soluble phenolic resin are kneaded with each other according to a conventional process, and a mold can be made from the kneaded mixture by utilizing the conventional self-hardening molding process as it is.

The silane coupling agent and silane compound used in the present invention may be mixed with an organic ester or a water-soluble phenolic resin before being added to the granular refractory material. Alternatively, they may be separately added to the granular refractory material without mixing. However, it is preferred that they be previously mixed with the organic ester or separately added.

In order to make a foundry sand mold by the gas-hardening molding process in the present invention, a kneaded sand prepared by adding to 100 parts by weight of a granular refractory material 0.001 to 1 part by weight, preferably 0.002 to 0.1 part by weight of a silane coupling agent, 0.001 to 10 parts by weight, preferably 0.002 to 5 parts by weight of the silane compound and 0.4 to 15 parts by weight of an aqueous solution of a water-soluble phenolic resin is packed into a pattern by bench molding or blowing by means of pressurized air. Then 0.05 to 9 parts by weight of a gaseous or aerosol organic ester is blown into the pattern for hardening, thereby making a mold.

In the present invention, a lactone or an organic ester derived from a monohydric or polyhydric alcohol having 1 to 10 carbon atoms and an organic carboxylic acid having 1 to 10 carbon atoms is used alone or in the form of a mixture. In the self-hardening molding process, it is preferred to use γ-butyrolactone, propionolactone, ε-caprolactone, ethyl formate, ethylene glycol diacetate, ethylene glycol monoacetate, triacetin, etc., while in the gas-hardening molding process, it is preferred to use methyl formate.

The water-soluble phenolic resin used in the present invention is a resin hardenable with an organic ester, and examples thereof include phenolic resins prepared by reacting phenols including phenol, cresol, resorcinol, 3,5-xylenol, bisphenol A and other substituted phenols with formaldehyde, acetaldehyde, furfural and mixtures thereof. Sodium hydroxide, potassium hydroxide, lithium hydroxide and mixtures thereof are suitable as an alkaline substance used for the condensation of the phenolic resin. Among them, potassium hydroxide is most desirable.

Besides quartz sand mainly composed of quartz, granular inorganic refractory materials, such as chromite sand, zircon sand, olivine sand, alumina sand, etc., may be used as the granular refractory material, though the granular refractory material is not limited to these only.

Examples of the alkyl silicate having an alkyl group having 1 to 8 carbon atoms used in the present invention include methyl silicate and ethyl silicate, and their lower condensates. Dimethylsiloxane, fluorinated silicone, epoxy-modified silicone, phenyl-modified silicone, alkylphenyl-modified silicone, polyether-modified silicone, etc. are used as the silicone oil.

Examples of the silane coupling agent used in the present invention include γ-aminopropyltriethoxysilane, γ-(2-aminoethyl)aminopropyltrimethoxysilane, and γ-glycidoxypropyltrimethoxysilane. In the present invention, the above-described silane coupling agent is used in combination with the binder.

The mold obtained by the invention has a strength higher than in the state of arts.

This enables the amount of use of the binder to be reduced, so that the recovery of molding sand becomes easy. Further, since the amount of gas generated from the mold during pouring can be reduced, the occurrence of gas defects can be suppressed and sound castings can be obtained, which renders the present invention useful from the viewpoint of practical use.

EXAMPLES

The present invention will now be described in more detail by way of the following Examples, though it is not limited to these Examples only.

Examples 1 to 6 and Comparative Example 1

Changes in the mold strength with time (hardening rate) in the self-hardening molding process were evaluated.

Specifically, a mixture prepared by kneading 100 parts by weight of chromite sand with 1.0 part by weight of a water-soluble phenolic resin (solid content: 49%, weight-average molecular weight: 2300) comprising 0.20 part by weight of triacetin and 0.5% by weight (based on the phenolic resin) of γ-aminopropyltriethoxysilane and 0.05 part by weight of various silane compounds listed in Table 1 was packed in a pattern for a test piece having a size of 50 mm in diameter and 50 mm in height to determine changes in the compressive strength after kneading with time.

The results are given in Table 1.

TABLE 1

| | | Compressive strength ($kg/cm^2$) room temp.: 25° C., humidity: 60% RH | | |
|---|---|---|---|---|
| | Silane compound | after 0.5 hr | after 1 hr | after 24 hr |
| Ex. 1 | ethyl silicate 28 (Nihon Colcoat Co., Ltd.) | 15.2 | 27.2 | 58.0 |
| Ex. 2 | ethyl silicate 40 (Nihon Colcoat Co., Ltd.) | 14.5 | 25.4 | 56.5 |
| Ex. 3 | silicone oil SH200 viscosity: 100 cP (Toray Silicone Co., Ltd.) | 16.8 | 24.0 | 53.5 |
| Ex. 4 | epoxy-modified silicone SF8411 (Toray Silicone Co., Ltd.) | 16.0 | 23.5 | 56.4 |
| Ex. 5 | alcohol-modified silicone SF8427 (Toray Silicone Co., Ltd.) | 15.0 | 23.0 | 52.0 |
| Ex. 6 | carboxy-modified silicone SF8418 (Toray Silicone Co., Ltd.) | 15.4 | 23.2 | 54.2 |
| Comp. Ex. 1 | none | 12.3 | 20.7 | 43.0 |

EXAMPLES 7 TO 13 AND COMPARATIVE EXAMPLE 2

Changes in the mold strength with time (hardening rate) in the gas-hardening molding process were evaluated.

Specifically, a mixture prepared by kneading 100 parts by weight of quartz sand with 2.0 parts by weight of a water-soluble phenolic resin (solid content: 49%, weight-average molecular weight: 2300) comprising 0.5% by weight (based on the phenolic resin) of γ-glycidoxypropyltrimothoxysilane and 0.05 part by weight of various silane compounds listed in Table 2 was packed in a pattern for a test piece having a size of 50 mm in diameter and 50 mm in height.

3.0 parts by weight of gaseous methyl formate was injected into this pattern to determine changes in the compressive strength after kneading with time.

The results are given in Table 2.

TABLE 2

| | Silane compound | Compressive strength ($kg/cm^2$) room temp.: 25° C., humidity: 60% RH after 0.5 hr | after 1 hr | after 24 hr |
|---|---|---|---|---|
| Ex. 7 | ethyl silicate 28 (Nihon Colcoat Co., Ltd.) | 13.5 | 20.2 | 28.3 |
| Ex. 8 | ethyl silicate 40 (Nihon Colcoat Co., Ltd.) | 13.0 | 19.8 | 28.0 |
| Ex. 9 | silicone oil SH200 viscosity: 100 cP (Toray Silicone Co., Ltd.) | 14.0 | 20.0 | 26.5 |
| Ex. 10 | fluorine-modified silicone FS1265 viscosity: 300 cP (Toray Silicone Co., Ltd.) | 14.2 | 20.2 | 27.0 |
| Ex. 11 | amino-modified silicone SF8417 (Toray Silicone Co., Ltd.) | 12.5 | 17.5 | 26.5 |
| Ex. 12 | carboxy-modifed silicone SF8418 (Toray Silicone Co., Ltd.) | 13.0 | 19.0 | 27.5 |
| Ex. 13 | polyether-modifed silicone SF8400 (Toray Silicone Co., Ltd.) | 13.5 | 20.0 | 27.0 |
| Comp. Ex. 2 | none | 10.2 | 15.1 | 24.0 |

We claim:

1. A process for making a foundry sand mold which comprises:

(a) making a granular refractory material with (1) binder comprising 0.001 to 1 part by weight of a silane coupling agent having the formula;

$$X-\overset{(CH_3)_{3-n}}{\overset{|}{Si}}-(OR)_n$$

wherein n is 2 or 3, R is methyl or ethyl and X is an organic reactive group capable of binding with an organic resin; 0.4 to 15 parts by weight of a water-soluble phenolic resin and 0.001 to 10 parts by weight of a silicone compound selected form the group consisting of an alkyl silicate having 1 to 8 carbon atoms or a lower condensate thereof, and a silicone ail; and (2) a hardening agent comprising 0.05 to 9 parts by weight of an organic ester; and (b) adding said mixture produced in step (a) to a mold to make said foundry sand mold.

2. The process as claimed in claim 1, which is conducted by the gas-hardening molding process or the self-hardening molding process.

3. The process according to claim 1, wherein said silane coupling agent, said silicone compound, said water-soluble phenolic resin, and said organic ester are first mixed together and then added to said granular refractory material.

4. The process according to claim 1, wherein said alkyl silicate is methyl silicate or ethyl silicate or lower condensates thereof.

5. The process according to claim 1, wherein said silicone oil is selected form the group consisting of dimethylsiloxane, fluorinated silicone, epoxy-modified silicone, phenyl-modified silicone and polyether-modified silicone.

6. The process according to claim 1, wherein said silane coupling agent is selected from the group consisting of γ-aminopropyltriethoxysilane, γ-(2-aminoethyl-)aminopropyltrimethoxysilane, and γ-glycidoxypropyltrimethoxysilane.

7. The process according to claim 1, wherein said organic reactive group is selected form the group consisting of a vinyl group, a methacrylate group, an epoxy group, an amino group and a mercapto group.

8. The process according to claim 1, wherein said silicone compound is present in 0.05 parts by weight.

9. A foundry molding composition comprising a granular refractory material and (1) a binder comprising 0.001 to 1 part by weight of a silane coupling agent having the formula;

$$X-\overset{(CH_3)_{3-n}}{\overset{|}{Si}}-(OR)_n$$

wherein n is 2 or 3, R is methyl or ethyl and X is an organic reactive group capable of binding with an organic resin; 0.4 to 15 parts by weight of a water-soluble phenolic resin and 0.001 to 10 parts by weight of a silicone compound selected from the group consisting of an alkyl silicate having 1 to 8 carbon atoms or a lower condensate thereof, and a silicone oil; and (2) a hardening agent comprising 0.05 to 9 parts by weight of an organic ester.

* * * * *